US007448228B2

(12) United States Patent
Han

(10) Patent No.: US 7,448,228 B2
(45) Date of Patent: Nov. 11, 2008

(54) SYSTEM OF ENERGY EFFICIENCY FOR REFRIGERATION CYCLE

(76) Inventor: Myung-Bum Han, 124-7 Songnim 2-Dong, Namdong-Gu, Incheon 405-072Incheon (KR)

( * ) Notice: Subject to any disclaimer, the term of this patent is extended or adjusted under 35 U.S.C. 154(b) by 475 days.

(21) Appl. No.: 10/551,241

(22) PCT Filed: Mar. 30, 2004

(86) PCT No.: PCT/KR2004/000720

§ 371 (c)(1),
(2), (4) Date: Sep. 28, 2005

(87) PCT Pub. No.: WO2004/088219

PCT Pub. Date: Oct. 14, 2004

(65) Prior Publication Data

US 2006/0196225 A1 Sep. 7, 2006

(30) Foreign Application Priority Data

Mar. 31, 2003 (KR) ..... 10-2003-0020251

(51) Int. Cl.
*F25B 41/00* (2006.01)

(52) U.S. Cl. ..... 62/513; 62/324.1

(58) Field of Classification Search ..... 62/114, 62/155, 324.1, 513
See application file for complete search history.

(56) References Cited

U.S. PATENT DOCUMENTS

| | | | | |
|---|---|---|---|---|
| 3,071,935 | A * | 1/1963 | Kapeker | 62/155 |
| 3,167,930 | A * | 2/1965 | Rasovich et al. | 62/81 |
| 3,960,322 | A * | 6/1976 | Ruff et al. | 62/228.1 |
| 6,192,695 | B1 * | 2/2001 | Hirota | 62/196.4 |
| 6,405,554 | B1 | 6/2002 | Kawakatu et al. | |

FOREIGN PATENT DOCUMENTS

| | | |
|---|---|---|
| JP | 06-137693 | 5/1994 |
| JP | 06-331223 | 11/1994 |
| JP | 2000-179960 | 6/2000 |
| JP | 2003-075026 | 3/2003 |

* cited by examiner

*Primary Examiner*—Melvin Jones
(74) *Attorney, Agent, or Firm*—IPLA P.A.; James E. Bame

(57) ABSTRACT

The improvement system of energy efficiency for the refrigeration cycle is comprised of: an auxiliary heat exchanger unit for heat-exchanging between refrigerant liquid having high pressure and refrigerant vapor having low pressure; and a cabinet which houses a pressure support value placed at an inlet of an inner pipe of the auxiliary heat exchanger unit, and a pressure of the refrigerant liquid having high pressure condensed at the outdoor heat exchanger is decreased by the pressure support value, and a condensed pressure of the outdoor heat exchanger is maintained. The system can be used to accompany with the ordinary air cooler and heat pump etc., and a conventional refrigerator can be utilized for both heating and cooling like the heat pump, thus leading to an increase of coefficient of performance and a decrease of consumption of electric power.

11 Claims, 8 Drawing Sheets

SYSTEM OF ENERGY EFFICIENCY FOR REFRIGERATION CYCLE

TECHNICAL FIELD

The present invention relates to a refrigeration cycle for vapor condensation and, more specifically, to an improvement system of energy efficiency for the refrigeration cycle in which it can be installed at an ordinary air cooler, a heat pump and a refrigerator so that it improves cooling efficiency or heating efficiency, and decreases consumption of electricity power, and specifically, an air conditioner can operate both cooling and heating like the heat pump does so that it exhibits superior heating/cooling efficiency.

BACKGROUND ART

As well known, a refrigeration cycle changes the temperature and pressure in a system and can lead to a phase change of refrigerant. By the latent heat of the evaporation or the latent heat of the condensation, the temperature of the indoor maintains properly or a refrigeration capacity like an ice manufacturing can be accomplished. It categories as an air conditioner like a cooler or a heat pump, a refrigerator and an icing maker according to its use.

A refrigeration cycle for vapor condensation (hereafter referred to "refrigeration cycle") is a system in which a compressor, a condenser, an expansion valve and an evaporator are connected orderly through a pipe to make a close circuit.

A saturated vapor refrigerant having low pressure and low temperature is compressed into a superheated vapor refrigerant having high pressure and high temperature via the isoentropy process at the compressor. The superheated vapor refrigerant enters to the condenser so that it heat-exchanges with a circumstance of air under constant pressure to release a heat and it is condensed to saturated liquid having high pressure. The condensed refrigerant passes through the expansion valve and is changed to wet vapor having low pressure and low temperature by throttling. Next, it passes through the condenser and absorbs the latent heat of the evaporation to evaporate. The saturated vapor reenters the compressor and repeats the above cycle.

For example, the air cooler in an air conditioner is an apparatus by which the evaporator is arranged at the indoor, the condenser is arranged at the outdoor, the refrigerant is evaporated by the latent heat of the evaporation which is absorbed from the indoor air.

On the other hand, the heat pump is an apparatus by which the evaporator is arranged at the indoor, the condenser is arranged at the outdoor, and the refrigerant flow direction is changed according to its use by operation of a 4-way valve, thereby carrying through a role change between the condenser and the evaporator. By the heat pump, it heats or cools the indoor using the latent heat of the evaporation that is absorbed by refrigeration evaporation and the latent heat of the condensation that is released by refrigeration liquefaction.

The performance of the refrigeration cycle is expressed by coefficient of performance (COP), which is defined as a ratio of the heat to the work. The heat is quantity of the absorbed heat at an evaporator or quantity of the condensed heat at a condenser, while the work is required when the refrigerant having low pressure and low temperature is compressed into one having high pressure and high temperature by a compressor.

Therefore, the refrigeration effect and a discharge heat capacity, which indicates the heat capacity absorbed when evaporating the refrigerant of 1 kg, must be increased to get superior performance in an air cooler and a heat pump.

However, if the refrigeration effect has increased above the increment along the increase of the compression work, coefficient of performance is rather worse or the consumption of electric power is increased. Coefficient of performance must be improved adequate to the system considering various matters such as a property of refrigerant.

Specially, during heating operation in winter, the refrigerant cannot sufficiently absorb the latent heat of the evaporation due to the low outdoor temperature, causing the evaporation inferiority. The degree of dry saturation of the refrigeration having low pressure is decreased and it leads to the occurrence of the compression inferiority owing to the wet compression. The specific volume of the inflowing refrigerant increases, leads to less generation volume of the condensed heat. It is hard to expect the sufficient heating performance. Moreover, overload is imposed on the compressor to cause the burnout. The consumption of electric power is increased by the large work capacity.

Conventional arts for improving the performance of the above air conditioner are found in Korean patent open-laid Nos. 2002-0070944 and 2002-0042775.

In patent open-laid No. 2002-0070944, the insulated first and second heat recovery apparatuses are installed between a 4-way valve of the heat pump system and an outdoor heat exchanger. Further, a third heat recovery apparatus is installed between a 4-way valve and a compressor. A high-pressure and low-pressure refrigerant pass through the first, second and third heat recovery apparatuses to do heat exchange reciprocally. Thus, the liquid refrigerant having high pressure is super-cooled and the refrigerant having low pressure is compensated for heat.

However, the third heat recovery apparatus is provided between the compressor and the 4-way valve in the heat pump system, the refrigerant having low pressure is flowing into the compressor with excessive heat when in cooling, and that system is very concerned about damage due to the superheating in the compressor. When in heating, the high-pressure refrigerant discharged from the compressor gives the considerable heat to the low-pressure refrigerant at the third heat recovery apparatus, and enters into the indoor heat exchanger. Not enough heating is anticipated.

Moreover, the liquid refrigerant having high pressure passes through an additional super-cooler so as to be super-cooled, which plans to increase the refrigeration effect. However, under the constant pressure, the liquid refrigerant having high pressure is simply dependent on thermal conduction, and it makes the degree of super-cooling to be lowered, and the volume decrease of flash gas of the expanded refrigerant is very slight.

In patent open-laid No. 2002-0042775, a special heat exchanger is installed between an outdoor heat exchanger of the heat pump system and an indoor heat exchanger. Further, using two 4-way valves, the liquid refrigerant having high pressure and the gas refrigerant having low pressure pass through the heat exchangers to make a heat exchange reciprocally. It makes the liquid refrigerant having high pressure super-cooled and also the gas refrigerant having low pressure super-heated, increasing coefficient of performance and decreasing compression work.

However, in this technology, the liquid refrigerant having high pressure does heat conduction at medium temperature under condensed pressure, and it causes a low degree of super-cooling. Since there exists a lot of difference to the evaporation pressure, the volume of flash gas of the evaporated refrigerant is large, and the low absorption volume of the latent heat of the evaporation can be gained. Therefore, the evaporation of heating operation is still inferior in winter.

Further, the quantity of conduction heat is very low comparing to vapor since the liquid refrigerant is simply dependent on heat conduction. More, due to the non-insulation of the heat exchanger, most heat of the liquid refrigerant is released to the air during the heat exchange process, which leads to very low degree of the super-heating of the gas refrigerant having low pressure. Therefore, it is hard to anticipate a decrease of compression load and to accomplish a deduction of consumption of electric power. Specially, no sufficient heating is expected due to lack of the heat capacity when in heating.

DISCLOSURE OF THE INVENTION

Accordingly, the present invention has been made keeping in mind the above problems occurring in the prior art, and an object of the present invention is to provide an improvement system of energy efficiency for the refrigeration cycle in which it increases coefficient of performance and decreases consumption of electric power in air conditioner such as air cooler and heat pump, and refrigerator.

Another object of the present invention is to provide an improvement system of energy efficiency for the refrigeration cycle in which it can be used to accompany with the ordinary air cooler and heat pump etc., and a conventional refrigerator can be utilized for both heating and cooling like the heat pump, thus leading to an increase of coefficient of performance and a decrease of consumption of electric power.

In order to accomplish the above object, the improvement system of energy efficiency for the refrigeration cycle in which refrigerant vapor having low pressure and low temperature is compressed into one having high pressure and high temperature and then is condensed by heat-exchange with circumstances; a condensed refrigerant liquid is expanded and then is evaporated by heat-exchange with a circumstance, and by which a heating and a cooling are performed, is comprised of: an auxiliary heat exchanger unit for heat-exchanging between refrigerant liquid having high pressure and refrigerant vapor having low pressure; and a cabinet which houses a pressure support value placed at an inlet of an inner pipe of the auxiliary heat exchanger unit, and a pressure of the refrigerant liquid having high pressure condensed at the outdoor heat exchanger is decreased by the pressure support value, and a condensed pressure of the outdoor heat exchanger is maintained.

Further, the auxiliary heat exchanger unit makes a heat-exchanging between refrigerant liquid having high pressure and refrigerant vapor having low pressure, and the auxiliary heat exchanger comprising of an inner pipe, one end of which is connected with an exit of the outdoor heat exchanger, the other end of which is connected with an inlet of the expansion valve; an outer pipe accommodating the inner pipe coaxially, one end of which is connected with an exit of the indoor heat exchanger, the other end of which is connected with an inlet of the compressor; and an insulation cover encompassing the outer pipe; a first pressure support valve is placed at an inlet of an inner pipe of the auxiliary heat exchanger unit, and decreases a pressure of the refrigerant liquid having high pressure condensed at the outdoor heat exchanger, and maintains condensed pressure of the outdoor heat exchanger; and a cabinet housing the auxiliary heat exchanger and the pressure support valve; the improvement system of energy efficiency for the refrigeration cycle further is comprising of a 4 way value for connecting an exit of the compressor, an inlet of the auxiliary heat exchanger unit, one end of the indoor heat exchanger and one end of the outdoor heat exchanger, and for converting flow direction of a refrigerant according to an operation mode; a second expansion valve connected with one end of the inner pipe of the auxiliary heat exchanger unit, and for expanding a refrigerant condensed at the indoor heat exchanger; and a second pressure support valve connected with the other end of the inner pipe of the auxiliary heat exchanger unit, a pressure of the refrigerant liquid having high pressure condensed at the outdoor heat exchanger is decreased by the pressure support valve, and a condensed pressure of the outdoor heat exchanger is maintained.

In accordance with a preferred feature of this invention, the auxiliary heat exchanger unit further has a heater that heats refrigerant vapor having low pressure and low temperature, and the heater is selectively operated under a predetermined temperature. The lack of the heat capacity of the vapor refrigerant, having low pressure and low temperature, can be compensated in the intense cold period.

According to the present invention, the pressure support valve maintains the condensed pressure of the gas refrigerant compressed into high pressure and high temperature refrigerant by compressor. The pressure of the liquid refrigerant having high pressure and medium temperature is decreased properly. The liquid having medium pressure and medium temperature and the gas refrigerant having low pressure and low temperature are inter-heat-exchanged at the insulated duplex pipe of the heat exchanger unit. Thus, the temperature of the liquid refrigerant can be significantly decreased. The vapor refrigerant is superheated.

Therefore, the volume of fresh gas is considerably reduced after the expansion of the liquid refrigerant, and the volume of absorption of the evaporation latent heat is increased. The condensed pressure is slightly reduced by the heat exchanger unit and the discharge pressure of the compressor is lessened, thus decreasing the compression work.

The present invention increases the refrigeration effect and coefficient of performance and decreases consumption of electric power. It leads to the performance improvement of heating/cooling of the heat pump.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

This invention will be described in further detail by way of exemplary embodiments with reference to the accompanying drawings.

Figure 1:
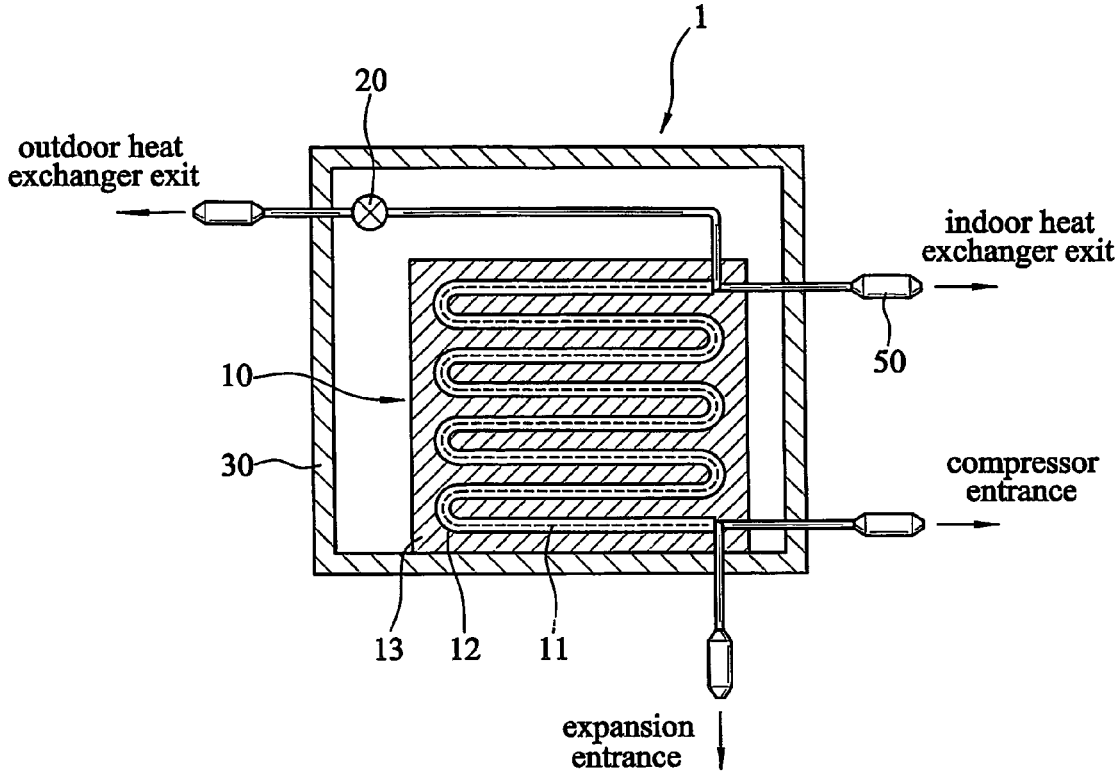
FIG. 1 is a schematic view illustrating an improvement system of energy efficiency for the refrigeration cycle according to the present invention.
Figure 2:
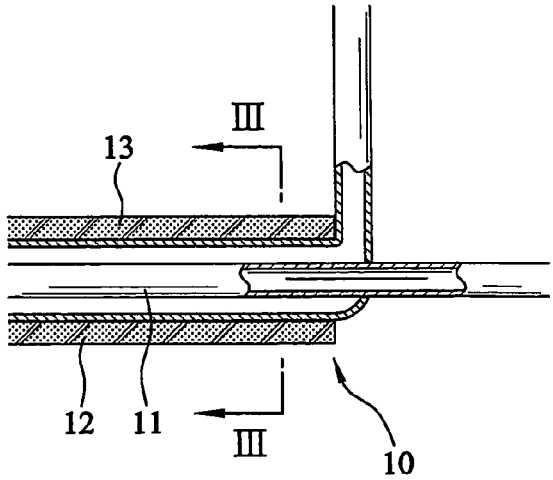
FIG. 2 is a partial exploded view showing an auxiliary heat exchange unit of an improvement system of energy efficiency for the refrigeration cycle according to the present invention.
Figure 3:
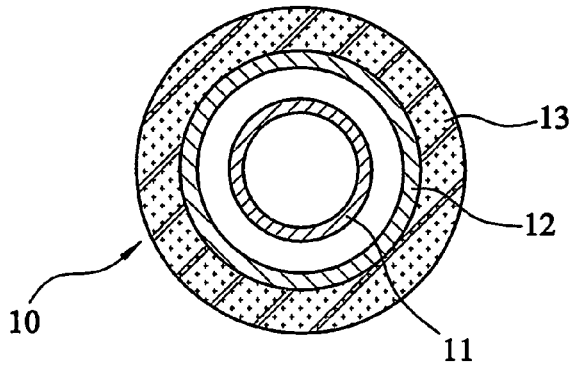
FIG. 3 is a cross-sectional view taken along line III-III of FIG. 2.

In FIGS. 1, 2 and 3, improvement system of energy efficiency for the refrigeration cycle 1 basically comprises an auxiliary heat exchanger unit 10 which is installed between an outdoor heat exchanger (condenser) and an indoor heat exchanger (evaporator) of refrigeration cycle, by which a condensed liquid refrigerant having medium temperature can be heat-exchanged with an evaporated vapor refrigerant having low temperature reciprocally. The improvement system further comprises a cabinet 30 that is provided between the outdoor heat exchanger and the auxiliary heat exchanger 10. An auxiliary heat exchanger 10, and a pressure support valve 20, are housed in the cabinet 30. The pressure support valve 20 maintains a condensed pressure of the outdoor heat exchanger, and reduces from high pressure and high temperature to medium pressure and medium temperature in a condensed liquid refrigerant.

The auxiliary heat exchanger unit 10 comprises an inner pipe 11 which is bent in a zigzag fashion so as to have a predetermined heat-exchanger length, an outer pipe 12 accommodating the inner pipe coaxially, and an insulation cover 13 to prevent the heat loss of the pipes.

One end of the inner pipe 11 is connected with an exit of the outdoor heat exchanger, and the other end thereof is connected with the inlet of the expansion valve.

One end of the outer pipe 12 is connected with an exit of the indoor heat exchanger, and the other end thereof is connected with an inlet of the compressor C. Since the outer pipe accommodates the inner pipe coaxially, a cross-section of the inner pipe except its thickness is same as the cross-section of the pipe of the indoor heat exchanger.

The insulation cover 13 can be simply configured as a box to encompass the dual heat exchanger, but preferably it is comprised of tubular insulator encompassing the outer pipe 12 as shown in Figures.

The pressure support valve 20 is installed at an inlet of the inner pipe 11 of the auxiliary heat changer unit 10. Using this, a cross-section of a flow pipe can be reduced so that a condensed liquid refrigerant having high pressure and medium temperature, and thus the refrigerant pressure before entering the pressure support valve maintains this difference after exiting the pressure support valve.

Figure 4:
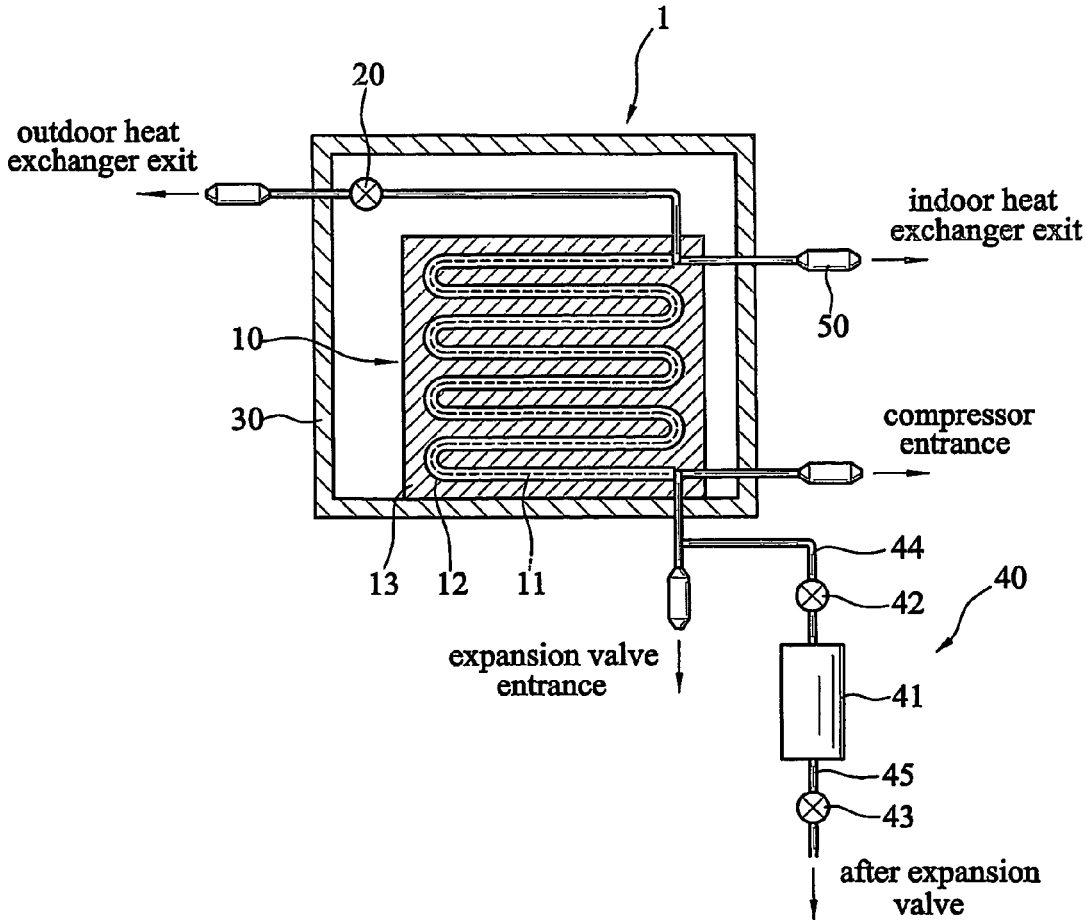
FIG. 4 is a schematic view illustrating an improvement system of energy efficiency for the refrigeration cycle of FIG. 1 that additionally provides a pressure compensator.

Preferably, the improvement system of energy efficiency for the refrigeration cycle 1, as shown in FIG. 4, can additionally provide a pressure compensator 40. The pressure compensator 40 maintains a pressure of refrigerant and an evaporating pressure irrespective of the condition such as load change, etc.

The pressure compensator 40 is consisted of a pressure compensation tank 41 for storing an additional refrigerant, a first pressure check valve 42 which guides the additional refrigerant into the pressure compensation tank 41 when over the predetermined pressure of the refrigerant, and a second pressure check valve 43 which discharges the refrigerant of the pressure compensation tank 41 when under the predetermined pressure of the refrigerant.

An inlet of the compensation tank 41 is connected to an inlet pipe 44 of an expansion valve, while an outlet of the compensation tank 41 is connected to an outlet pipe 45 of the expansion valve.

The first pressure check valve 42 is provided at an inlet pipe of the pressure compensation tank 41 and opens only when over the predetermined pressure of the refrigerant. The second pressure check valve 43 is provided at an outlet pipe 45 of the pressure compensation tank 41 and opens only when under the predetermined pressure of the refrigerant.

On the other hand, in the preventive system 1, pipes P connecting each component in an ordinary refrigerating cycle may be cut. The inner pipe 11 and the outer pipe 12 of the auxiliary heat exchange unit 10 are placed between the cut pipes, and are connected by welding. Otherwise, as shown FIG. 4, an additional joint 50 is provided at both ends of the inner pipe 11 and the outer pipe 12, respectively.

Figure 5:
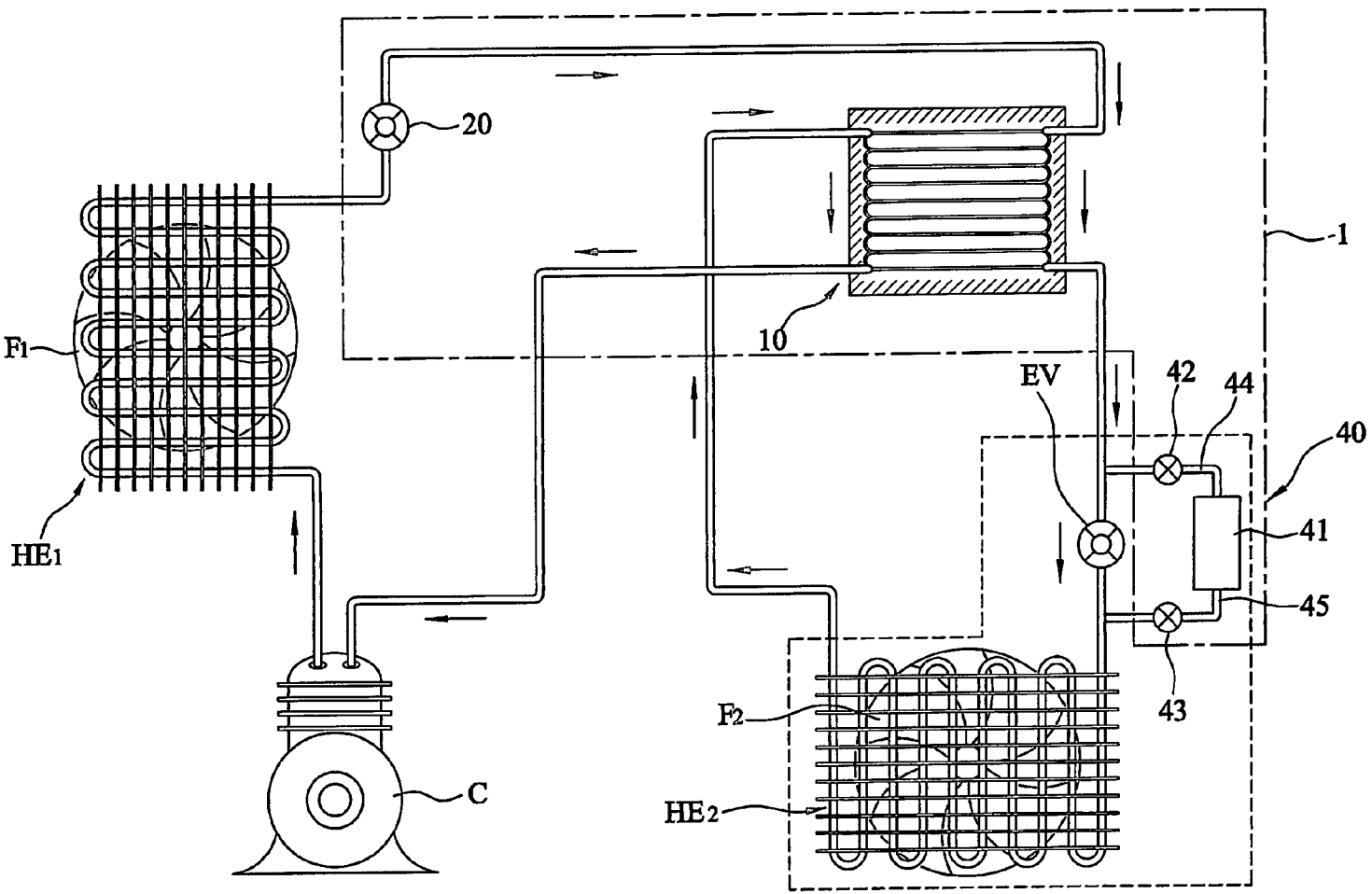
FIG. 5 is a schematic view illustrating an ordinary cooler being employed in an improvement system of energy efficiency for the refrigeration cycle.
Figure 6:
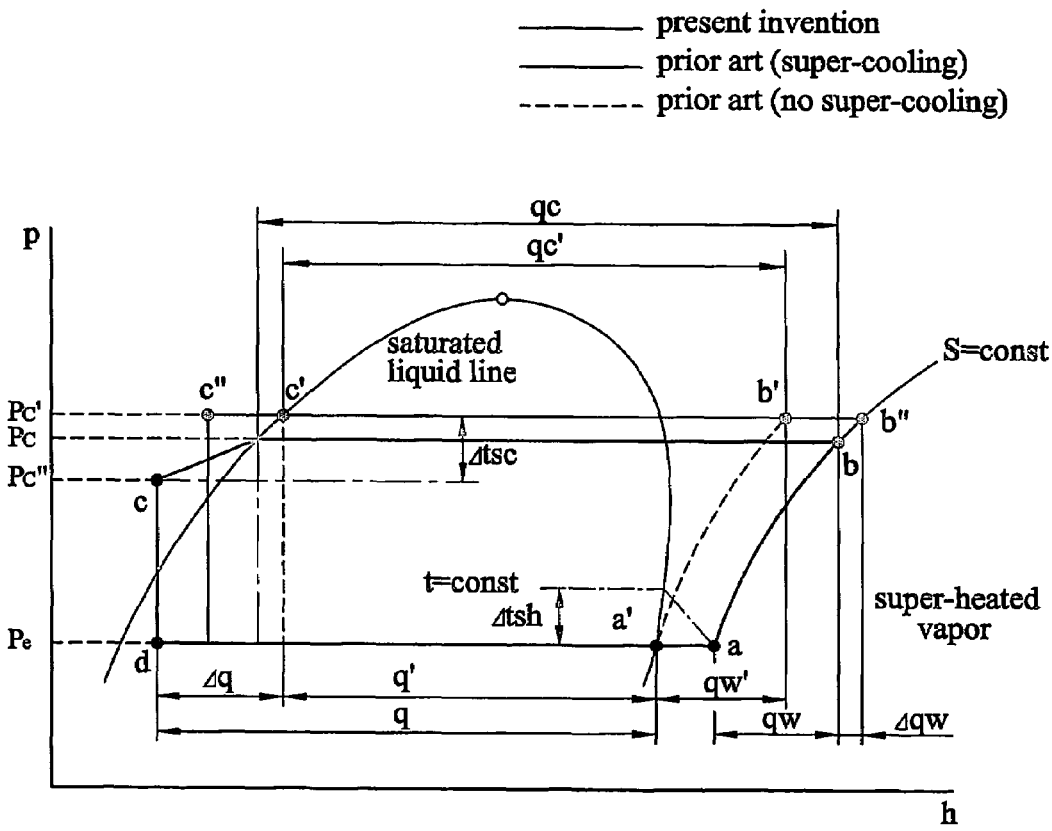
FIG. 6 is a p-h diagram illustrating an effect of the refrigeration cycle provided at the improvement system of energy efficiency for the refrigeration cycle according to the present invention.

An action of the improvement system of energy efficiency for the refrigeration cycle is illustrated referring to FIGS. 5 and 6.

A gas refrigerant is compressed at the compressor C, converting into high pressure and high temperature one. The refrigerant flows through the outdoor heat exchanger $HE_1$, and discharges latent heat by the heat exchange with an airflow generated by a fan $F_1$. The gas is condensed into wet vapor having high pressure and medium temperature.

The condensed liquid refrigerant is passed through the pressure support valve 20 having a reduced channel, and its pressure and temperature is reduced (Pc→Pc"). The refrigerant is converted to medium pressure and medium temperature refrigerant. Next, the converted liquid refrigerant flows through the inner pipe of the auxiliary heat exchanger unit 10, and makes a heat exchange with a vapor refrigerant that flows through the inside of the outer pipe 12. Thus, as shown in FIG. 6, temperature c' is reduced to c by Δ tsc, thus reducing enthalpy.

In other word, the liquid refrigerant having high pressure and medium temperature flows through the pressure support valve 20 to firstly reduce pressure and temperature. The liquid refrigerant makes a heat exchange with the vapor refrigerant having low pressure and low temperature. Since the heat exchanger of the auxiliary heat exchanger unit 10 is configured as double pipe, the heat exchange between each other occurs along the whole circumstances of the inner pipe 11. Further, the outer pipe 12 has the insulation cover 13 to accomplish a solid insulation. It leads to a minimal heat loss and makes sure to occur between a liquid refrigerant and a vapor refrigerant so that the temperature of the liquid refrigerant is lowered.

At this time, as the pressure of the inner pipe 11 of the auxiliary heat exchanger unit 10 is lowered, the pressure of the outdoor heat exchanger $HE_1$ escapes to the inner pipe 11. However, owing to the pressure support valve 20, as shown in FIG. 6, the condensed pressure of the outdoor heat exchanger $HE_1$ is reduced to Pc from Pc'.

Therefore, a discharge pressure of the refrigerant from the compressor C has the reduced value, and it leads to less compression work. But, there is no severe effect to the condensation of the vapor refrigerant. As illustrated in p-h diagram shown in FIG. 6, in characteristic of refrigeration cycle, at the same level evaporate pressure Pe, less condensed pressure Pc, and more refrigeration effect, and leading to a reduced compression work.

While passing through the auxiliary heat exchanger unit 10, the liquid refrigerant has lower pressure and temperature. Next, the refrigerant flows through the expansion valve EV to contract, and it is converted as a low pressure and temperature one. The difference of pressure and temperature before and after the expansion valve EV can be reduced significantly comparing to the past. The volume of flash gas contained in the expanded refrigerant is reduced drastically because of less contribution in heat absorption.

Most expanded refrigerant flows through the indoor heat exchanger $HE_2$ and absorbs the evaporated latent heat from the airflow generated by the fan $F_2$. Thus, the refrigeration effect increases largely by Δ q (i.e. from q' to q).

The evaporated vapor refrigerant having low pressure and temperature flows through the outer pipe 12 of the auxiliary heat exchanger unit 10 and makes the heat exchange with the liquid refrigerant having medium pressure and medium temperature in the adiabatic state. The evaporated vapor refrigerant absorbs the heat to be changed into the superheated vapor and enters again to the compressor C.

The entering refrigerant is compressed at the compressor C and is discharged to the outdoor heat exchanger $HE_1$. As the gas refrigerant is entered as the superheated condition and is compressed, the temperature increases by Δ tsh (i.e. a'→a) comparing to the past. However, since the condensed pressure Pc has lower value by the pressure support valve 20 and the auxiliary heat exchanger unit 10, the discharge pressure decreases. Therefore, the work of the compressor C decreases by Δ qw (i.e. qw'→qw), lessening the consumption of electric power.

As result, the present invention has the increased refrigerant effect than the prior in the refrigeration cycle, and has the less compressed work, greatly improving the performance coefficient.

More, even if the pressure of both liquid refrigerant and vapor refrigerant is varied according to the circumstance condition like weather etc., the pressure compensator 40 can always constantly maintain the liquid refrigerant of the auxiliary heat exchanger unit 10 and the evaporate pressure Pe of the indoor heat exchanger $HE_2$, thus operating the stable refrigeration cycle.

In other words, when the pressure in the system varies owing to the external factor, and the condensed liquid refrigerant has the higher pressure than the set pressure, the first pressure control check valve 42 of the pressure compensator 40 is opened. The excessive volume of the refrigerant flows to the pressure compensation tank 41 to maintain the pressure of the liquid refrigerant, while when the evaporate pressure is lower than the set pressure, the second pressure control check valve 43 is opened. The refrigerant contained in the pressure compensation tank 41 is supplied to the system to maintain the evaporate pressure.

Figure 7:
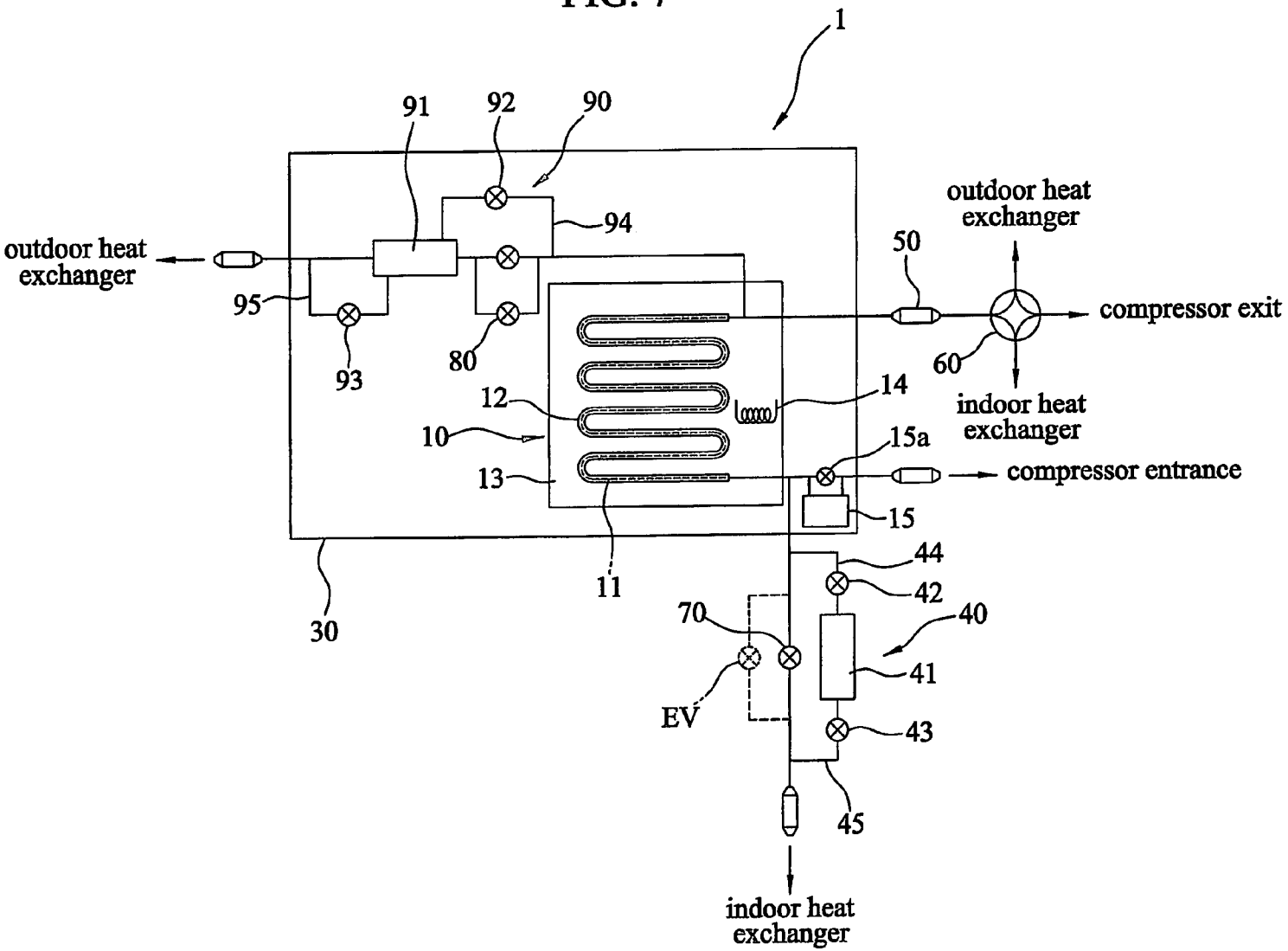
FIG. 7 is another embodiment of the improvement system of energy efficiency for the refrigeration cycle according to the present invention.

FIG. 7 illustrates another embodiment of the improvement system of energy efficiency for the refrigeration cycle 1 according to the present invention.

The embodiment comprises components mentioned at the previous embodiment as well as a 4-way valve, a second pressure support valve 70, and a second expansion valve 80.

The 4-way valve 60 changes the refrigerant flow direction to the outdoor heat exchanger $HE_1$ or the indoor heat exchanger $HE_2$. The second pressure support valve 70 decreases the pressure of the liquid refrigerant condensed at the indoor heat exchanger $HE_2$, and maintains the condensed pressure as constant. The second expansion valve 80 expands the liquid refrigerant, having the medium pressure and medium temperature that enters to the outdoor heat exchanger $HE_1$ through the auxiliary heat exchanger unit 10, to the predetermined evaporate pressure. Thus, the cooling unit of the embodiment can be utilized for both cooling and heating like a heat pump.

The 4-way valve 60 connects with an exit of the compressor C, an inlet of the outer pipe 12 of the auxiliary heat exchanger-unit 10, an exit of the outdoor heat exchanger $HE_1$ and an exit of the indoor heat exchanger $HE_2$. According to an operation mode, the flow of the refrigerant discharged from the compressor C directs either the outdoor heat exchanger $HE_1$ or the indoor heat exchanger $HE_2$.

The pressure support valve 20 and the second expansion valve 80 are arranged in a row, while the expansion valve EV and the second pressure support valve 70 are also arranged in a row. The valves are, respectively, made from a check valve by which the refrigerant flows only one way.

Furthermore, in the embodiment, the flow of the refrigerant can be changed according to an operation mode to accomplish the heating or the cooling. The pressure compensator 40, 90 is respectively placed before and after the auxiliary heat exchanger 10 and can be selectively operated according to cooling mode and heating mode.

In a case of the pressure compensator 90 that operates at the heating mode, preferably, the refrigerant pipe is provided through the inside of the pressure compensation tank 91. By this, the expanded refrigerant having low pressure and low temperature absorbs the heat from the liquid refrigerant in the pressure compensation tank 91 and supplements the lack of the heat capacity in winter.

The auxiliary heat exchanger unit 10 comprises further a heater 14 by which the lack of the heat capacity of the vapor refrigerant, having low pressure and low temperature, can be compensated. The heater 14 selectively operates in the intense cold period when the outdoor temperature lowers below the evaporate temperature. The heater 14 is installed at an exit of the outer pipe 12 of the auxiliary heat exchanger unit 10, and is operated by an evaporate temperature sensor (not shown).

Further, when an outdoor temperature is very low, there is a concern that wet compression occurs owing to an instable evaporation of refrigerant. Thus, an accumulator 15 for collecting the wet refrigerant can be further provided at an exit of the outer pipe 12. The accumulator 15 can be provided with a valve 15*a*, and the refrigerant goes through the accumulator 15 when only in heating mode.

Figure 8:
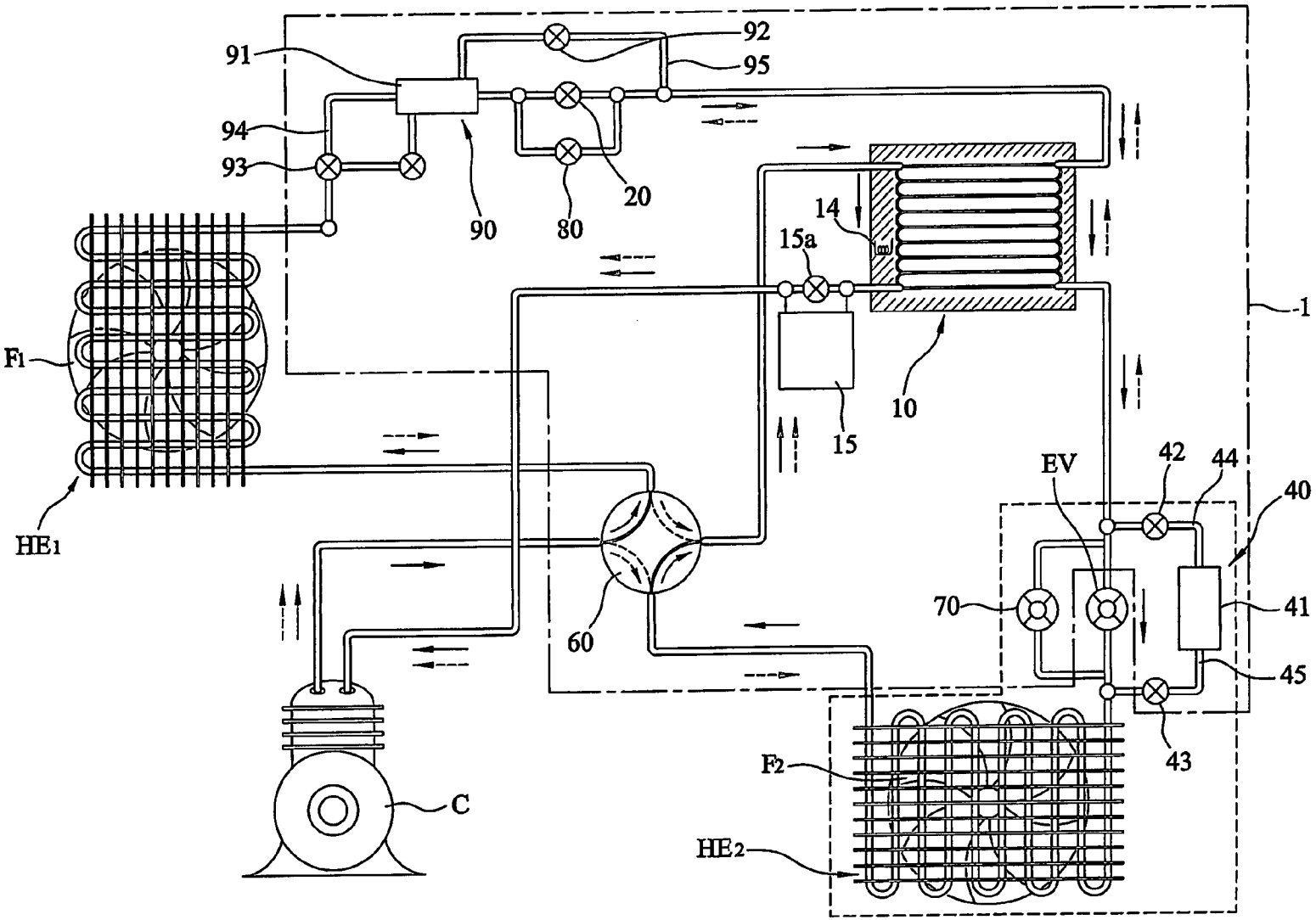
FIG. 8 is a schematic view illustrating an ordinary cooler being employed in the embodiment of FIG. 7.

FIG. 8 illustrates an ordinary cooler employing the above embodiment, in which it can run in both a cooling mode and a heating mode as a heat pump.

The operation of a heating mode (a solid line arrow) is identical to that described in the above embodiment, and therefore needs to no further description here.

In a heating mode (a dot line arrow), the gas refrigerant having high pressure and high temperature discharges from the compressor C, and enters to the indoor heat exchanger $HE_2$ by the 4-way valve 60. While passing through the indoor heat exchanger $HE_2$, the gas refrigerant does a heat exchange with an indoor air to release a latent heat and changes to the condensate refrigerant. The condensate heat accomplishes the heating. The liquid refrigerant having high pressure and medium temperature flows through the second pressure support valve 70 and lowers its pressure and temperature.

Sequentially, the liquid refrigerant having medium pressure and medium temperature flows through the inner pipe 11 of the auxiliary heat exchange unit 10. The liquid refrigerant does a heat exchange with the vapor refrigerant having low pressure and low temperature that flows though the outer pipe 12 in an a diabatic condition. Thus, the temperature of refrigerant greatly lowers. The refrigerant becomes a super cooling state.

And also, as the pressure of the inner pipe 11 decreases, the refrigerant of the outdoor heat exchanger $HE_1$ flows into the inner pipe 11. However, as shown In FIG. 6, the condensate pressure of the indoor heat exchanger $HE_1$ decreases from Pc' to Pc by the pressure support valve 20 to maintain the lower condition.

The liquid refrigerant being super-cooled at the auxiliary heat exchanger unit 10 flows through the second expansion valve 80, and is contracted to become a low pressure and a low temperature refrigerant. Since the difference is small between the refrigerant pressure as well as between the refrigerant temperature before and after the second expansion valve 80, the volume of flash gas contained in the expanded refrigerant is drastically reduced.

Therefore, the refrigerant easily absorbs the expansion latent heat from the outside air during passing the outdoor heat exchanger $HE_1$.

The evaporated vapor refrigerant having low pressure and low temperature flows through the outer pipe 12 of the auxiliary heat exchanger unit 10, and does a heat exchange with the liquid refrigerant, having medium pressure and medium temperature, flowing through the inner pipe 11. The vapor refrigerant absorbs the heat from the liquid refrigerant to become a super heated state.

Even if there occurs the evaporation deficiency at the outdoor heat exchanger $HE_1$ due to the lower temperature of the outdoor air, the certain evaporation arises by the heat from the liquid refrigerant. Further, since the refrigerant passes through the accumulator 15, the super-heated dry vapor refrigerant having low pressure enters into the compressor C.

The super-heated vapor refrigerant is again compressed at the compressor C, and discharges to the indoor heat exchanger $HE_2$. The temperature of the gas refrigerant increases from a' to a by Δ tsh since the gas refrigerant is compressed with the super-heated state. The condensate pressure Pc is lowered comparing to the past by the second pressure support valve 70 and the auxiliary heat exchanger unit 10, leading to a lower discharge pressure.

Therefore, work capacity of the compressor C decreases from qw' to qw by Δ qw, thus lessening consumption of electric power, and simultaneously the discharge heat capacity of the indoor heat exchanger $HE_2$ increases from qc' to qc. This sufficiently accomplishes the indoor heating with great efficiency.

When the temperature of the outdoor is excessively lower than the evaporate temperature, the heater 14 installed at the auxiliary heat exchanger 10 can operate to compensate the heat capacity to the vapor refrigerant having low pressure, accomplishing the heating irrespective of the outdoor temperature.

At the heating, the pressure and the evaporate pressure of the liquid refrigerant can always maintain constant by the second pressure compensator 90, ensuring the stable operation. Further, the lack of heat capacity of the outdoor air in winter can be compensated since the refrigerant pipe passes through the inside of the pressure compensation tank 91.

The non-describing numeral 92 is a third expansion valve, 93 is a check valve, and 94,95 are refrigerant pipe. The check valve 93 acts the refrigerant flows only one way. The third expansion valve 92 sends the liquid refrigerant, having low pressure and low temperature, flowing through the pipe 95, and the refrigerant heat-exchanges at the second pressure compensation tank 90.

Figure 9:
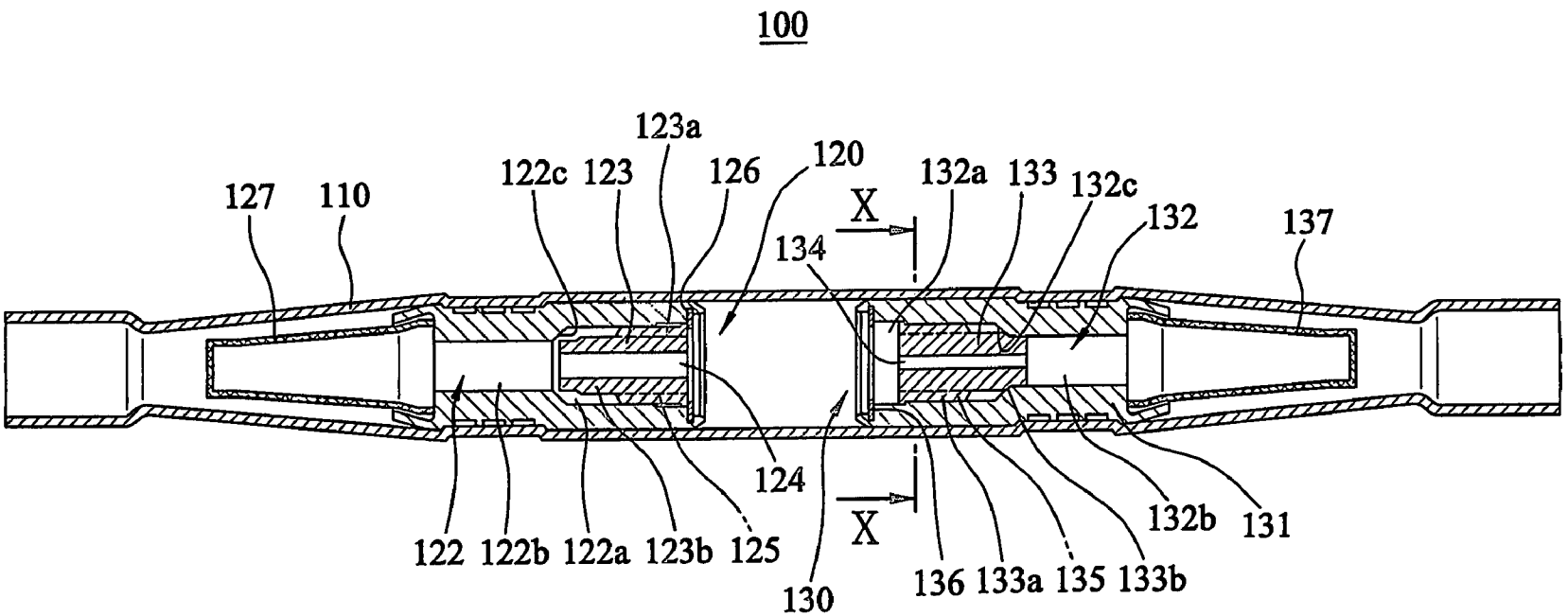
FIG. 9 is another embodiment an expansion valve and a pressure support valve employed in the improvement system of energy efficiency for the refrigeration cycle according to the present invention.
Figure 10:
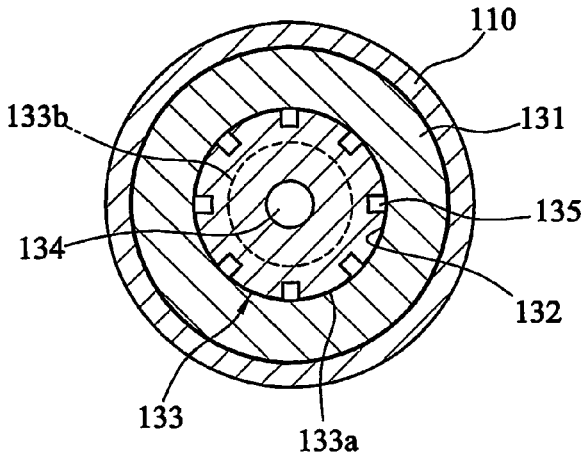
FIG. 10 is a cross-sectional view taken along line X-X of FIG. 9.

FIGS. 9 and 10 illustrate the other embodiment of both the expansion valve EV and the second pressure support valve 70, and both the second expansion valve 80 and the pressure support valve 20 comparing to the second embodiment described above.

Each expansion valve and pressure support valve is arranged in one body housing in a row, and allows bi-directional refrigerant flow. That is configured as a dual flow control valve 100 that controls the flow volume depending on a flow direction.

The pressure support valve 120 is air-tightly provided at one end of the inside of the sleeve housing 110, while the expansion valve 130 is air-tightly provided at the other end thereof. In the pressure support valve 120 and the expansion valve 130, the diameter of the respective orifice 124, 134 has a different size, but all configurations are the same. Therefore, for convenience, corresponding numerals are designated to the corresponding part. The following explains the expansion valve 130.

The expansion valve 130 comprises a cylinder 131 that has a bore 132 in the center thereof and has a different diameter in coaxial, and is provided in the housing 110. The expansion valve 130 further comprises a valve body 133 that has an orifice 134 in the center thereof and contacts with the larger diameter portion 132*a* of the bore 132 of the cylinder 131, and slides axially. The expansion valve 130 furthermore comprises a ring stopper 136 that provides contact at one end of the cylinder 131 to prevent the valve body 132 from slipping out.

The valve body 133 is configured as a conical shape corresponding to the bore 132 of the cylinder 131, and plural grooves 135 are formed at circumstances of the large diameter portion 133*a* of the valve body 133 in a regular angle. The sum of the cross-section of the orifice 134 and the cross-section of every groove 135 is configured as the same as the cross-section of refrigerant channel. The numeral 137 is designated as a screen.

When in the heating cycle, the valve body 123 of the pressure support valve 120 moves toward the stopper 126, which opens grooves 125 formed at a circumstance of the larger diameter portion 123. The refrigerant flows through the orifice 124 and the grooves 125 of the valve body 123. The valve body 133 of the expansion valve 130 moves away from the stopper 136, and the smaller diameter portion 132*b* of the valve body 133 is fitted in the smaller diameter portion 132*b* of the cylinder 131.

Simultaneously, the grooves 135 formed on the larger diameter portion 133*a* of the expansion valve body 133 is contacted on the conical form 132*c* of the cylinder bore 132 to block the refrigerant flow through the grooves 135. Therefore, the refrigerant passes through only the orifice 134 of the expansion valve body 133, thus being contracted.

In the other hand, when in the cooling cycle, the above operation is performed in an opposite way, and decreases the pressure and the temperature of the liquid refrigerant.

Figure 11:
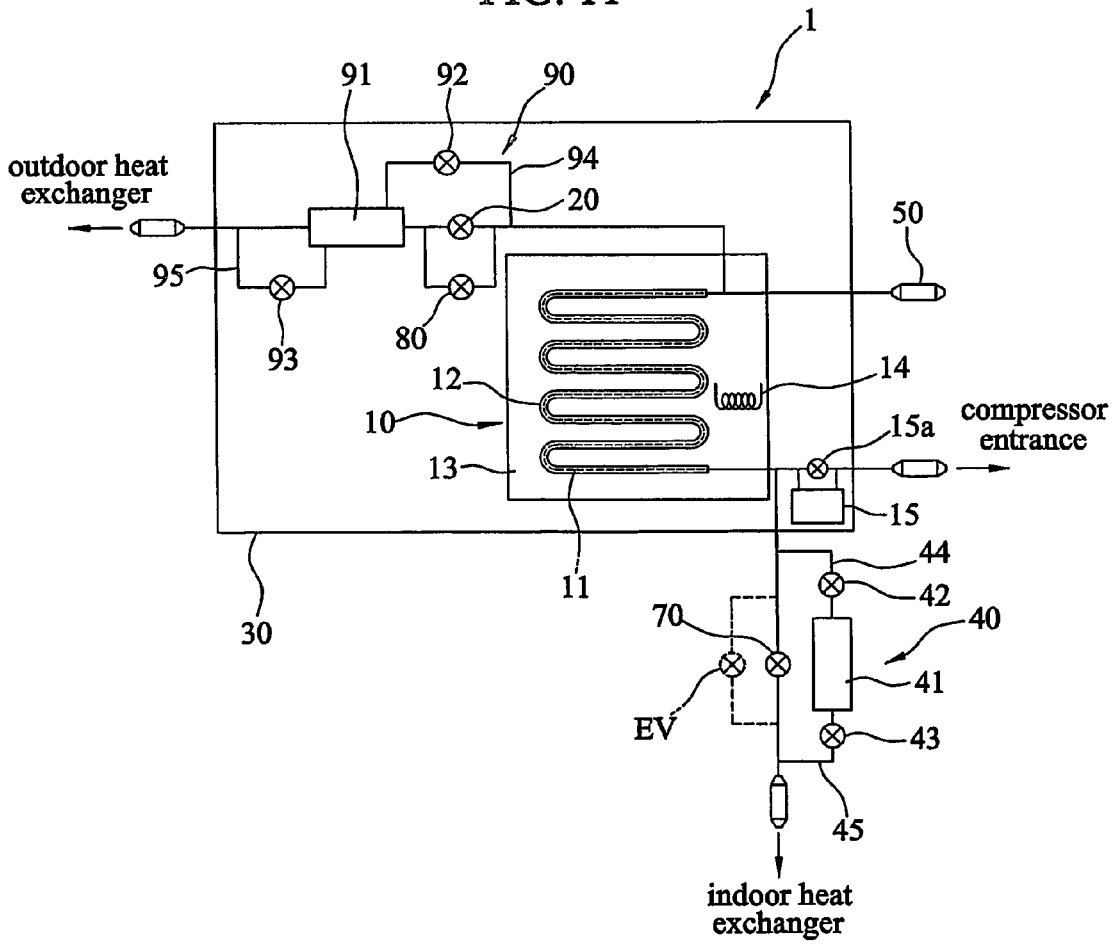
FIG. 11 shows other embodiment of the improvement system of energy efficiency for the refrigeration cycle according to the present invention.

FIG. 11 shows other embodiment of the improvement system of energy efficiency for the refrigeration cycle according to the present invention.

The technology is a configuration that installs at the heat pump. The system comprises of an auxiliary heat exchanger unit 10 by which refrigerant liquid having high pressure makes a heat-exchange with refrigerant vapor having low pressure, a first pressure support value 20 placed at an inlet of an inner pipe of the auxiliary heat exchanger unit 10, and for decreasing a pressure of the refrigerant liquid having high pressure condensed at the outdoor heat exchanger $HE_1$, and for maintaining condensed pressure of the outdoor heat exchanger $HE_1$. The system further comprises a second expansion value 80 connected with one end of the inner pipe of the auxiliary heat exchanger unit 10, and for expanding a refrigerant condensed at the indoor heat exchanger $HE_2$; a second pressure support value 80 connected with the other end of the inner pipe of the auxiliary heat exchanger unit 10, a pressure of the refrigerant liquid having high pressure condensed at the outdoor heat exchanger $HE_1$ is decreased by the pressure support value, and a condensed pressure of the outdoor heat exchanger is maintained; and a cabinet 30 housing the auxiliary heat exchanger 10 and the pressure support valve.

Each of the components of the above embodiment is the same as those of the second embodiment. Therefore, the detail description is omitted. In this case, the pressure compensator 40, 90, the heater 14 and the accumulator 15 are provided surely.

Further, it is not shown in Figures, but both the expansion valve EV and the second pressure support valve 70, and both the second expansion valve 70 and the pressure support valve 80 are configured as the dual flow control valve 100 as shown in FIG. 9. The dual valve can be arranged in a row on the pipe.

INDUSTRIAL APPLICABILITY

As described above, according to the improvement system of energy efficiency for the refrigeration cycle of this invention, it is possible to increase the refrigeration of the cooler and the refrigerator, and to increase coefficient of performance. The less compression work leads to the reduced consumption of electricity power.

Further, the invention improves cooling efficiency or heating efficiency, and decreases consumption of electricity power, and specifically, an air conditioner can operate both cooling and heating like the heat pump does so that it exhibits superior heating/cooling efficiency.

Furthermore, the present invention increases the refrigeration effect and coefficient of performance and decreases consumption of electric power. It leads to the performance improvement of heating/cooling of the heat pump.

The invention claimed is:

1. Improvement system of energy efficiency for the refrigeration cycle in which refrigerant vapor having low pressure and low temperature is compressed into one having high pressure and high temperature and then is condensed by heat-exchange with circumstances; a condensed refrigerant liquid is expanded and then is evaporated by heat-exchange with a circumstance, and by which a heating and a cooling are performed, comprising of:

an auxiliary heat exchanger unit for heat-exchanging between refrigerant liquid having high pressure and refrigerant vapor having low pressure;

a cabinet which houses a pressure support valve placed at an inlet of an inner pipe of the auxiliary heat exchanger unit, and a pressure of the refrigerant liquid having high pressure condensed at the outdoor heat exchanger is decreased by the pressure support valve, and a condensed pressure of the outdoor heat exchanger is maintained;

a pressure compensator, consisting of a pressure compensation tank connecting to an inlet pipe of an expansion valve and storing an additional refrigerant;

a first pressure check valve provided at an inlet pipe of the pressure compensation tank and being open only over the predetermined pressure of the refrigerant; and a second pressure check valve provided at an outlet pipe of the pressure compensation tank and being open only under the predetermined pressure of the refrigerant.

2. Improvement system of energy efficiency for the refrigeration cycle according to claim 1, wherein: the auxiliary heat exchanger unit makes a heat-exchanging between refrigerant liquid having high pressure and refrigerant vapor having low pressure, and the auxiliary heat exchanger comprising of an inner pipe, one end of which is connected with an exit of the outdoor heat exchanger, the other end of which is connected with an inlet of the expansion valve; an outer pipe accommodating the inner pipe coaxially, one end of which is connected with an exit of the indoor heat exchanger, the other end of which is connected with an inlet of the compressor; and an insulation cover encompassing the outer pipe;

a first pressure support valve is placed at an inlet of an inner pipe of the auxiliary heat exchanger unit, and decreases a pressure of the refrigerant liquid having high pressure condensed at the outdoor heat exchanger. and maintains condensed pressure of the outdoor heat exchanger; and a cabinet housing the auxiliary heat exchanger and the pressure support valve; the improvement system of energy efficiency for the refrigeration cycle further comprising of:

a 4 way valve for connecting an exit of the compressor, an inlet of the auxiliary heat exchanger unit, one end of the indoor heat exchanger and one end of the outdoor heat exchanger, and for converting flow direction of a refrigerant according to an operation mode;

a second expansion valve connected with one end of the inner pipe of the auxiliary heat exchanger unit, and for expanding a refrigerant condensed at the indoor heat exchanger; and a second pressure support valve connected with the other end of the inner pipe of the auxiliary heat exchanger unit, a pressure of the refrigerant liquid having high pressure condensed at the outdoor heat exchanger is decreased by the pressure support valve, and a condensed pressure of the outdoor heat exchanger is maintained.

3. Improvement system of energy efficiency for the refrigeration cycle according to claim 2, wherein: the expansion valve, the second pressure support valve, the second expansion valve, and the first pressure support valve are arranged in a row, and further includes a check valve by which only one way flow can be allowed.

4. Improvement system of energy efficiency for the refrigeration cycle according to claim 2, wherein both the expansion valve and the second pressure support valve and both the second expansion valve and the pressure support valve are respectively housed in one body in a row with a distance from each other, the valve group is configured as a dual flow control valve by which bi-directional flows are allowed, and the flow volume is decreased depending on the flow direction.

5. Improvement system of energy efficiency for the refrigeration cycle according to claim 4, wherein the dual flow control valve comprises a sleeve housing connected to each refrigerant pipe by each end of the sleeve housing; two cylinders installed air-tightly in the housing, distanced against each other, and having two diameter bores in coaxial, and a conical area provided between the bores; and two valve bodies having a different diameter orifice at each center, respectively, providing plural axial grooves at a circumstance of each larger diameter portion, the circumstances of each valve having a confronting conical area to the conical area of each cylinder, and sliding axially in the larger diameter bore of each cylinder in a predetermined stroke; thereby each valve body moves any one direction simultaneously following the refrigerant flow direction, the grooves of any one valve body is contacted with the bores conical area of the corresponding cylinder, and the refrigerant flow is blocked.

6. Improvement system of energy efficiency for the refrigeration cycle according to any one claim of claims 2 to 5, wherein the auxiliary heat exchanger unit further has a heater that heats refrigerant vapor having low pressure and low temperature, and the heater is selectively operated under a predetermined temperature.

7. Improvement system of energy efficiency for the refrigeration cycle according to claim 6, further comprising of a pressure compensator provided between the auxiliary heat exchanger and the indoor heat exchanger, between the auxiliary heat exchanger and the outdoor heat exchanger, respectively, the pressure compensator consisting of a pressure compensation tank connecting to an inlet pipe of the expansion valve and storing an additional refrigerant; a first pressure check valve provided at an inlet pipe of the pressure compensation tank and being open only over the predetermined pressure of the refrigerant; and a second pressure check valve provided at an outlet pipe of the pressure compensation tank and being open only under the predetermined pressure of the refrigerant.

8. Improvement system of energy efficiency for the refrigeration cycle according to claim 7, wherein a refrigerant pipe is installed through the pressure compensation tank of the pressure compensator that operates during the heat mode.

9. Improvement system of energy efficiency for the refrigeration cycle according to claim 8, further comprising of an accumulator provided at an outer exit pipe of the heat exchanger unit for filtering moisture of refrigerant.

10. Improvement system of energy efficiency for the refrigeration cycle according to claim 1 or 2, wherein a joint is provided at both inner pipe ends of the heat exchanger unit and at both outer pipe ends of the heat exchanger unit.

11. Improvement system of energy efficiency for the refrigeration cycle in which refrigerant vapor having low pressure and low temperature is compressed into one having high pressure and high temperature and then is condensed by heat-exchange with a circumstance; a condensed refrigerant liquid is expanded and then is evaporated by heat-exchange with a circumstance, and by which a heating and a cooling are performed, comprising of:

an auxiliary heat exchanger unit making a heat-exchange between refrigerant liquid having high pressure and refrigerant vapor having low pressure, and the auxiliary heat exchanger comprises an inner pipe, one end of which is connected with an exit of the outdoor heat exchanger, the other end of which is connected with an inlet of the expansion valve; an outer pipe accommodating the inner pipe coaxially, one end of which is connected with an exit of the indoor heat exchanger, the other end of which is connected with an inlet of the compressor; and an insulation cover encompassing the outer pipe;

a first pressure support valve placed at an inlet of an inner pipe of the auxiliary heat exchanger unit, and for decreasing a pressure of the refrigerant liquid having high pressure condensed at the outdoor heat exchanger, and for maintaining condensed pressure of the outdoor heat exchanger;

a 4 way valve for connecting an exit of the compressor, an inlet of the auxiliary heat exchanger unit, one end of the indoor heat exchanger and one end of the outdoor heat exchanger, and for converting flow direction of a refrigerant according to an operation mode;

a second expansion valve connected with one end of the inner pipe of the auxiliary heat exchanger unit, and for expanding a refrigerant condensed at the indoor heat exchanger; and a second pressure support valve connected with the other end of the inner pipe of the auxiliary heat exchanger unit, a pressure of the refrigerant liquid having high pressure condensed at the outdoor heat exchanger is decreased by the pressure support valve, and a condensed pressure of the outdoor heat exchanger is maintained; and a cabinet housing the auxiliary heat exchanger and the pressure support valve.

* * * * *